United States Patent [19]

Gall

[11] Patent Number: 4,492,485

[45] Date of Patent: Jan. 8, 1985

[54] ERROR CORRECTING TYPEWRITER FOR SIMPLIFIED WORD OBLITERATION

[75] Inventor: John C. Gall, Chicago, Ill.

[73] Assignee: Sears, Roebuck and Co., Chicago, Ill.

[21] Appl. No.: 183,547

[22] Filed: Sep. 2, 1980

[51] Int. Cl.[3] ..... B41J 29/16

[52] U.S. Cl. ..... 400/697.1; 400/214; 400/697; 400/466

[58] Field of Search ..... 400/696, 697, 697.1, 400/214, 466

[56] References Cited

U.S. PATENT DOCUMENTS

| | | | |
|---|---|---|---|
| 640,254 | 1/1900 | Anderson | 400/261 |
| 1,905,118 | 4/1933 | Nadell | 400/696 |
| 2,142,761 | 1/1939 | Quinn | 400/697 |
| 2,462,833 | 3/1949 | Angel | 400/308 |
| 3,114,447 | 12/1963 | Wolowitz | 400/240.1 |
| 3,141,539 | 7/1964 | Wolowitz | 400/240.1 |
| 3,149,711 | 9/1964 | Wolowitz | 400/697.1 |
| 3,154,318 | 10/1964 | Wolowitz | 400/697.1 |
| 3,204,745 | 9/1965 | Wolowitz | 400/697.1 |
| 3,270,852 | 9/1966 | Fondiller | 400/312 |
| 3,397,767 | 8/1968 | Hobbs | 400/697.1 |
| 3,595,362 | 7/1971 | Wolowitz | 400/216.2 |
| 3,729,081 | 4/1973 | Ozimek et al. | 400/216.1 |
| 3,773,160 | 11/1973 | Rava et al. | 400/466 |
| 3,780,846 | 12/1973 | Kolpek et al. | 400/697.1 X |
| 3,799,316 | 3/1974 | Davidge et al. | 400/697.1 |
| 3,862,679 | 1/1975 | Ozimek et al. | 400/697 |
| 3,866,736 | 2/1975 | Ozimek et al. | 400/697 |
| 3,882,990 | 5/1975 | Genesio | 400/697.1 |
| 3,905,465 | 9/1975 | Frechette et al. | 400/214 |
| 3,927,746 | 12/1975 | Wolowitz | 400/697.1 X |
| 3,927,747 | 12/1975 | Wolowitz | 400/208 |
| 3,927,748 | 12/1975 | Wolowitz | 400/217.1 |
| 3,927,749 | 12/1975 | Wolowitz | 400/216.1 |
| 3,987,885 | 10/1976 | Diamond | 400/697.1 |
| 3,997,046 | 12/1976 | Wolwitz | 400/697.1 |
| 3,997,047 | 12/1976 | Wolowitz | 400/697.1 |
| 4,007,823 | 2/1977 | Barouh et al. | 400/240.1 |
| 4,108,557 | 8/1978 | Skrzipek et al. | 400/697.1 |
| 4,203,681 | 5/1980 | Gall et al. | 400/697 |

FOREIGN PATENT DOCUMENTS

| | | | |
|---|---|---|---|
| 7610046 | 8/1977 | Netherlands | 400/697.1 |
| 528589 | 11/1940 | United Kingdom | 400/697 |
| 2031626 | 4/1980 | United Kingdom | 400/697.1 |

OTHER PUBLICATIONS

IBM Technical Disclosure Bulletin, "Multiple Character Erase", Hanft et al., vol. 23, No. 3, Aug. 1980, pp. 1107–1108.

IBM Service Manual Supplement for Selectric Typewriter, Form 241-5724-0, Feb. 1973, (pp. 3–11).

*Primary Examiner*—Ernest T. Wright, Jr.

*Attorney, Agent, or Firm*—Welsh & Katz, Ltd.

[57] ABSTRACT

Mechanisms are disclosed for modifying conventional single element and typebar typewriters, having character-for-character correction systems, with automatic backspacing or non-backspacing, and non-forward spacing, after obliteration, to provide an additional operational mode whereby character-for-character correction can be achieved with automatic forward spacing, after each obliteration, thereby to provide simplified word obliteration.

10 Claims, 7 Drawing Figures

(MODIFIED PRIOR ART)

ERROR CORRECTING TYPEWRITER FOR SIMPLIFIED WORD OBLITERATION

BACKGROUND OF THE INVENTION

This invention relates to an error correcting typewriter and more particularly to an error correcting typewriter providing means for selectively effecting character-for-character correction or sequential letter or word obliteration and correction.

The prior art discloses typewriters embodying structures which require different sequences of operation for performing a correcting function. The prior art relating to error correcting typewriters is exemplified by the following U.S. Patents, Davidge et al., U.S. Pat. No. 3,799,316; Skrizipek, U.S. Pat. No. 4,108,557 and Gall et al., U.S. Pat. No. 4,203,681, each of which is directed to the correction of a single character in which the erroneous character is obliterated and a correct character is retyped in its place. However, if it is desired to obliterate a series of characters, as in a word or in a line, multiple operations must be repeated in order to effect such obliteration and correction. From a human engineering standpoint this is highly undesirable. Advantageously, the operator should be able to correct a word or line with a minimum number of typing strokes and without intensive concentration as to the sequence of steps required.

In Davidge et al., Pat. No. 3,799,316, which employs a letter-on-letter correction system the following sequence of operations is required for correcting a single letter:

(1) Position the carriage to the space immediately following the erroneous character.

(2) Actuate a control key which causes the carriage to backspace a single space, conditions a correction medium (ribbon) to be operative for the next single print cycle, and disengages the carrier space escapement such that it remains inoperative only for the one following print cycle.

(3) Actuate the erroneous letter printing key which effects a print function through the correction medium, resets the correction medium to the inoperative mode, and reengages the carrier escapement mechanism to its normal typing mode.

(4) Actuate the correct character printing key.

If it is desired to obliterate a series of characters, such as a word or a line, the following sequence of operations is required:

(1) Position the carriage to the space following the last letter of the word.

(2) Actuate the control key to condition the machine and reverse space.

(3) Actuate the print key corresponding to the character to be obliterated (subsequent operations repeat operations 2, then 3, then 2 until the entire word is obliterated).

In Skrizipek U.S. Pat. No. 4,108,557, which utilizes an obliterating blank type face, the following sequence of operations is required for the correction of a single character:

(1) Position the carriage to the space immediately following the erroneous character.

(2) Actuate a control key which initiates a reverse space operation and subsequently conditions the correction medium to be operative, prints an obliterating area through the correction medium (ribbon) and returns the ribbon to the inoperative mode. No space escapement occurs due to the intentional failure to operate this mechanism.

(3) Actuate the correct character printing key.

In order to obliterate a series of characters the following sequence of operations is required:

(1) Position the carriage to the space following the last character of the word.

(2) Actuate the control key to reverse space and obliterate the character (subsequent operations repeat operation 2 as required).

In Gall et al., U.S. Pat. No. 4,203,681 which utilizes an obliterating blank type face, the following sequence of operations is required for correcting a single character:

(1) Position the carriage in line with the erroneous character.

(2) Actuate a control key which conditions the correction medium to be operative, temporarily disables the carrier space escapement mechanism, prints the obliterating area through the correction medium, returns the correction medium to an inoperative mode and returns the character escapement mechanism to its normal typing mode.

(3) Actuate the correct character printing key.

In order to obliterate a series of characters, the following sequence of operations is required:

(1) Position the carriage in line with the last or first character of the word.

(2) Actuate the control key to obliterate the character.

(3) Actuate the reverse space key or forward space bar.

In susequent operations repeat operation 2 then 3 then 2 and so forth, as required.

OBJECTS OF THE INVENTION

One of the objects of this invention is the provision in a typewriter of operator selective means for effecting obliteration and/or correction of single characters or a series of characters in sequence, such as in a word or in a line.

Another object of this invention is the provision in a typewriter of separate means selectively operable by the operator to effect obliteration and/or correction of single characters in one mode or a series of characters in sequence, such as in a word or in a line in another mode.

Still another object of this invention is the provision in a typewriter having means for obliterating and/or correcting a character by a character-for-character mode, of additional means selectively operable to obliterate and/or correct a series of characters in sequence, in a more efficient manner requiring fewer manipulations on the part of the operator.

DESCRIPTION OF THE INVENTION

Figure 1:
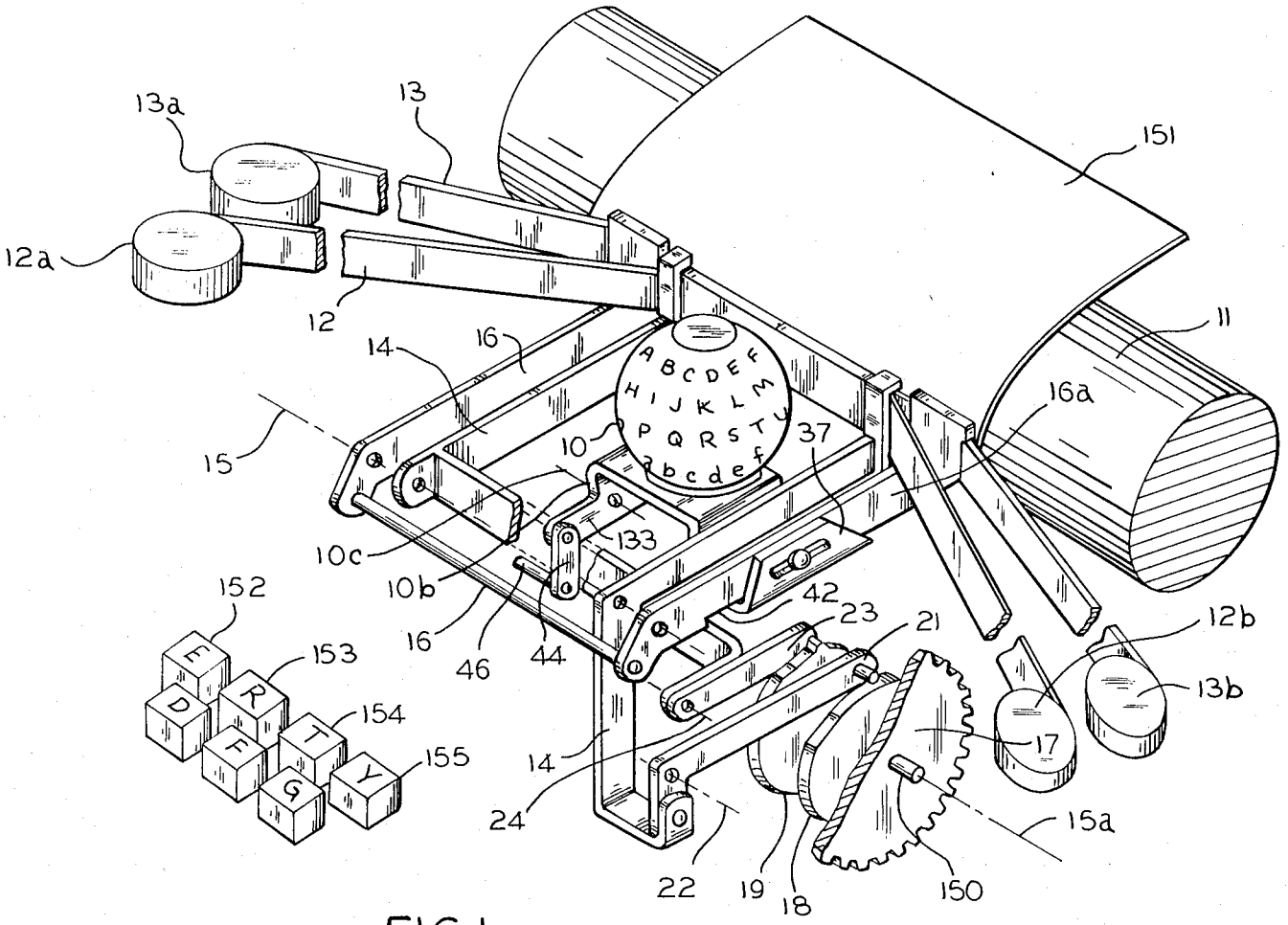
FIG. 1 (PRIOR ART)
FIG. 1 is a fragmentary perspective view of a prior art typewriter showing a single type element and the operating mechanism for printing through an obliterating ribbon.
Figure 2:
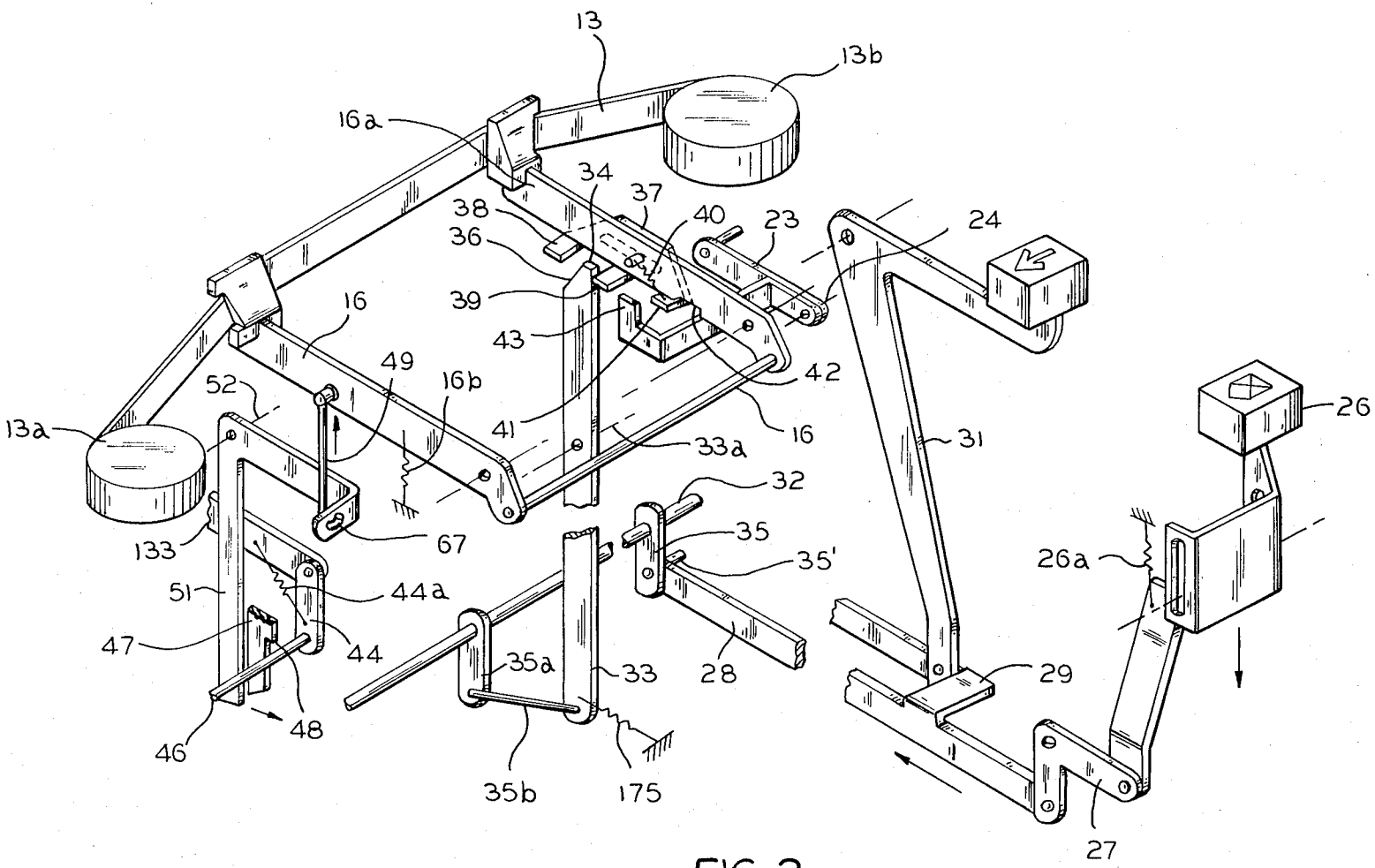
FIG. 2 (PRIOR ART)
FIG. 2 is a similar view showing other mechanism of the same typewriter related to the error correction features.

FIGS. 1 and 2 illustrate portions of a commercial single type element typewriter, model 7800, produced by Brother Industries, Ltd. of Japan. Only those portions of the typewriter which are affected by the present invention are shown, it being understood that the balance of the typewriter is of conventional construction with normal prior art functions. In addition, it will be understood that like reference numerals refer to like elements in the several views.

Referring to FIG. 1, a type element 10 is mounted on a yoke **10*b* pivotable about an axis 10*c* with the yoke 10*b* including an extending bell crank 133 from which is pivotally mounted an arm 44 whose function will be hereinafter described. The type element 10 is positioned in close proximity to a movable platen 11 and is arranged to impact thereon in a printing operation. A printing ribbon 12 and correcting ribbon 13 are interposed between the type element 10 and the platen 11 and are independently carried by ribbon vibrator yokes 14 and 16, respectively, between supply and take-up spools 12*a*, 12*b* and 13*a*, 13*b* both of the yokes 14 and 16 being pivoted on axis 15, and the yoke 16 normally being held down by spring 16*b*, as shown in FIGS. 2–6. In non-operating mode both ribbons 12 and 13 are normally disposed below the point of impact of the type element 10 on the platen 11. A gear 17 and cams 18 and 19 are fixed on a driven shaft 150, having an axis 15*a*. The shaft 150 is caused to be rotated during any machine operation of a print function. When such a print function is initiated cam 18 is caused to be rotated and effects upward rocking of bell crank 21 about its pivotal axis 22. The vibrator yoke 14 which is pivotally connected to bell crank 21 will elevate print ribbon 12 to an operative position so that the selected character on the type element 10 will be imprinted on a sheet of paper 151 surrounding the platen 11. Concurrent rotation of cam 19 will effect upward rocking of bell crank 23 about its pivotal axis 24. The function of bell crank 23** will hereinafter be described.

Additional parts of the above typewriter which are involved in letter-on-letter correcting functions are shown in FIG. 2. These include a vertically slidable control key 26 which when depressed in the direction of the arrow will rock bell crank 27 clockwise to shift the link 28 in the direction of the arrow and which when released will be returned to its original position by spring **26*a*. Link 28 includes a laterally extending tab 29 which abuts and actuates backspace key lever 31 to backspace the platen 11 one character space. Concurrently, shaft 32 through rigid arms 35, 35*a* and link 35*b* rocks lever 33 about its pivotal axis 33*a* in a clockwise direction against the biasing action of spring 175. The free upper end 34 of lever 33 has a camming edge 36 and cooperates with a slide member 37 slidably secured to an arm 16*a* of ribbon vibrator yoke 16. The slide member 37 has three integral laterally directed tabs 38,39 and 41, respectively. End 34 of lever 33 normally is disposed in the space between tabs 38 and 39. A tension spring 40 normally biases slide member 37 rearwardly or to the left, as viewed in FIG. 2. When lever 33 is rocked clockwise, as above described, lever end 34 abuts tab 39 shifting it forwardly so that tab 41 will be caused to engage in detent 42 provided in the right hand arm 16*a* of yoke 16. Concurrently, tab 39 has moved to a position over arm 43 which is rigid with bell crank 23. Because the control key 26 is not a print function, gear 17 and cam 19 are not caused to rotate and, accordingly, bell crank 23 is not actuated. When control key 26 is released the parts return to their at rest positions. However, slide member 37 remains in latched position with tab 41 engaged in detent 42**. The machine now has backspaced and is conditioned for a print function.

Actuation of an erroneous character key such as, 153, 154 and 155, e.g., 152 will initiate such a print function in which rotation of cam 19 will effect rocking of arm 43 upwardly to engage tab 39 thereby lifting correcting ribbon vibrator yoke 16 and with it correcting ribbon 13 so that the correcting ribbon 13 now is interposed in operative position between type element 10 and platen 11. However, printing ribbon 12 also has been raised through action of cam 18 and bell crank 21 so that both correcting ribbon 13 and printing ribbon 12 are in registry, with correcting ribbon 13 being interposed between printing ribbon 12 and platen 11. The erroneous character on type element 10 will now impact on printing ribbon 12 which in turn will impact on correcting ribbon 13 so that it contacts the paper 151 on the platen 11 and effects obliteration of the character on the paper 151. Concurrently, the upward rocking movement of yoke **10*b* raises bell crank 133 which is connected to yoke 10*b* which in turn raises pivotally mounted arm 44 carrying a laterally extending pin 46. Arm 44 is biased by a spring 44*a* in the direction of a member 47 which actuates the spacing function. Pin 46 normally engages member 47 at shoulder 48. However, the upward rocking of yoke 16 through link 49 will rotate bell crank 51 counterclockwise about its axis 52, whereby the depending arm of bell crank 51 will engage and displace pin 46 to clear shoulder 48 so that spacing will not be effected. As ribbon vibrator yoke 16 is lowered to its non-operative position, tab 38 of slide member 37 will engage the camming edge 36 of lever 33. This action will disengage tab 41 from detent 42 permitting spring 40 to return slide member 37** to normal position.

In a typewriter construction just described only the character keys control the single type element 10 to initiate printing. The control key 26, when actuated, does not initiate printing.

Figure 3:
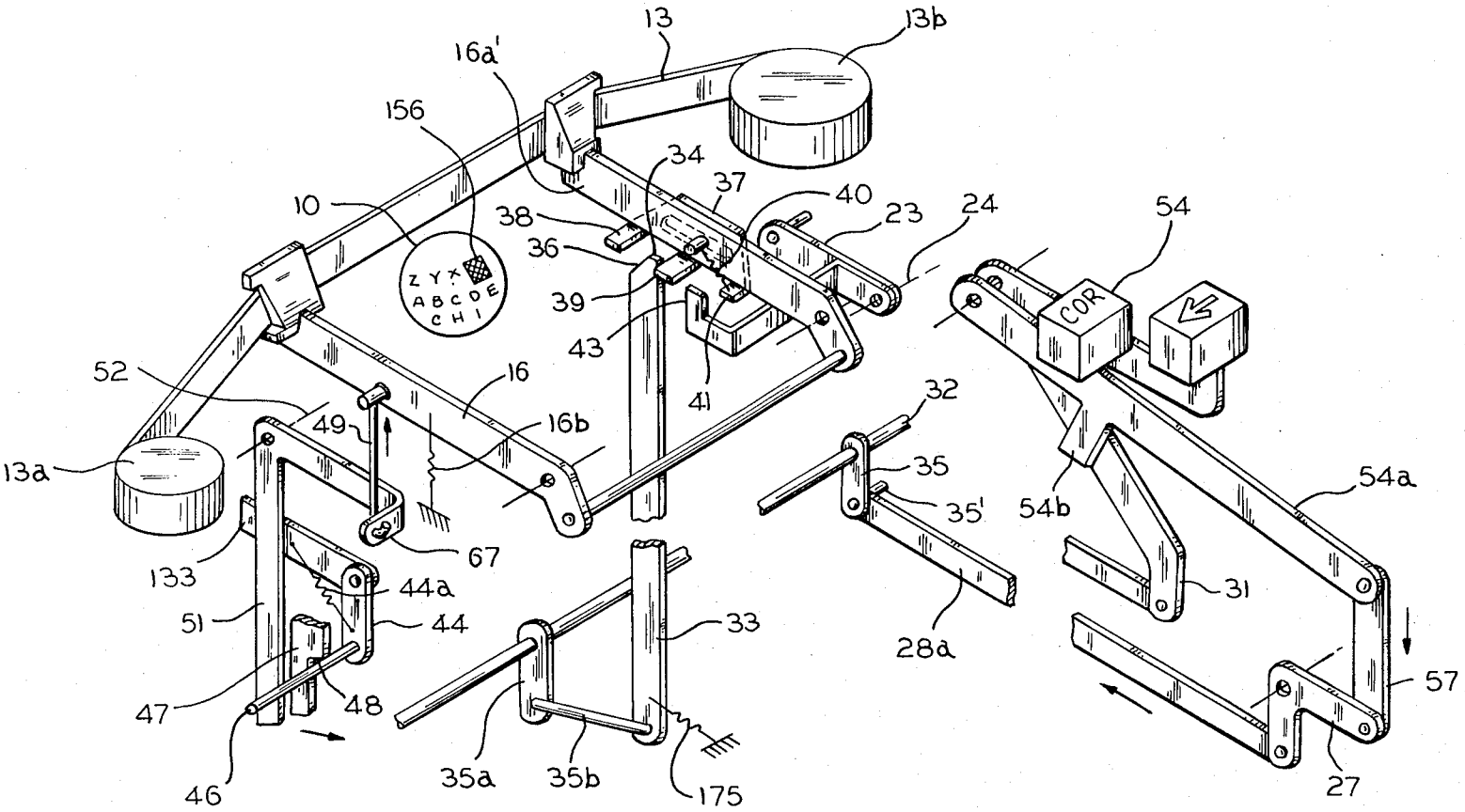
FIG. 3 is a fragmentary perspective view, similar to FIG. 2, but showing a modified construction.

FIG. 3 illustrates a modified embodiment of the construction shown in FIGS. 1 and 2. In this embodiment a print function key (correction key) 54 is employed to replace the control key 26 of FIG. 2. The key 54 is mounted on a key lever **54*a* having a depending extension 54*b* and is connected by link 57 to bell crank 27. Also, it is noted that the laterally extending tab 29 of link 28 has been omitted from link 28*a* and detent 42 has been omitted from leg 16*a*. In this embodiment the type element 10 includes an obliterating type face 156**.

In operation when correction key 54 is depressed the initial travel of lever **54*a* conditions the typewriter mechanism for correction while final travel positions the obliterating type face 156 for impact on the platen 11. Specifically, actuation of correction key 54 through lever 54*a*, link 57, bell crank 27 and lever 28*a* will effect rocking of lever 33 in the same manner, as previously described. Because of the omission of tab 29, the backspace key lever 31 will not be actuated. However, the extension 54***b* will initiate a normal printing function of the typewriter. As lever 33 rocks in a clockwise direction, the upper end 34 will shift slide member 37 forwardly so that tab 39 is superposed directly over arm 43. Because detect 42 has been omitted slide member 37 can remain in such superposed position only while the correction key 54 is held depressed and during the activation of the printing function. Under such condition cam 19, in rotating, rocks bell crank 23 and arm 43 to raise the ribbon vibrator yoke 16 and with it correcting ribbon 13. As correction key 54 is a printing function key it is related to the position of a character on the type element 10 which in this instance is obliterating type face 156 which will be aligned for impact at the print point. At the instant of impact ribbons 12 and 13 are in registry and obliteration of a printed character is effected, as previously described. Release of correction key 54 returns all components to their inoperative positions. As all correction functions are effected within a single print cycle, correction key 54 may be used as a repeat key, it being noted that deflection of pin 46 by bell crank 51 away from engagement with member 47 will prevent spacing when correction key 54 is depressed.

Figure 4:
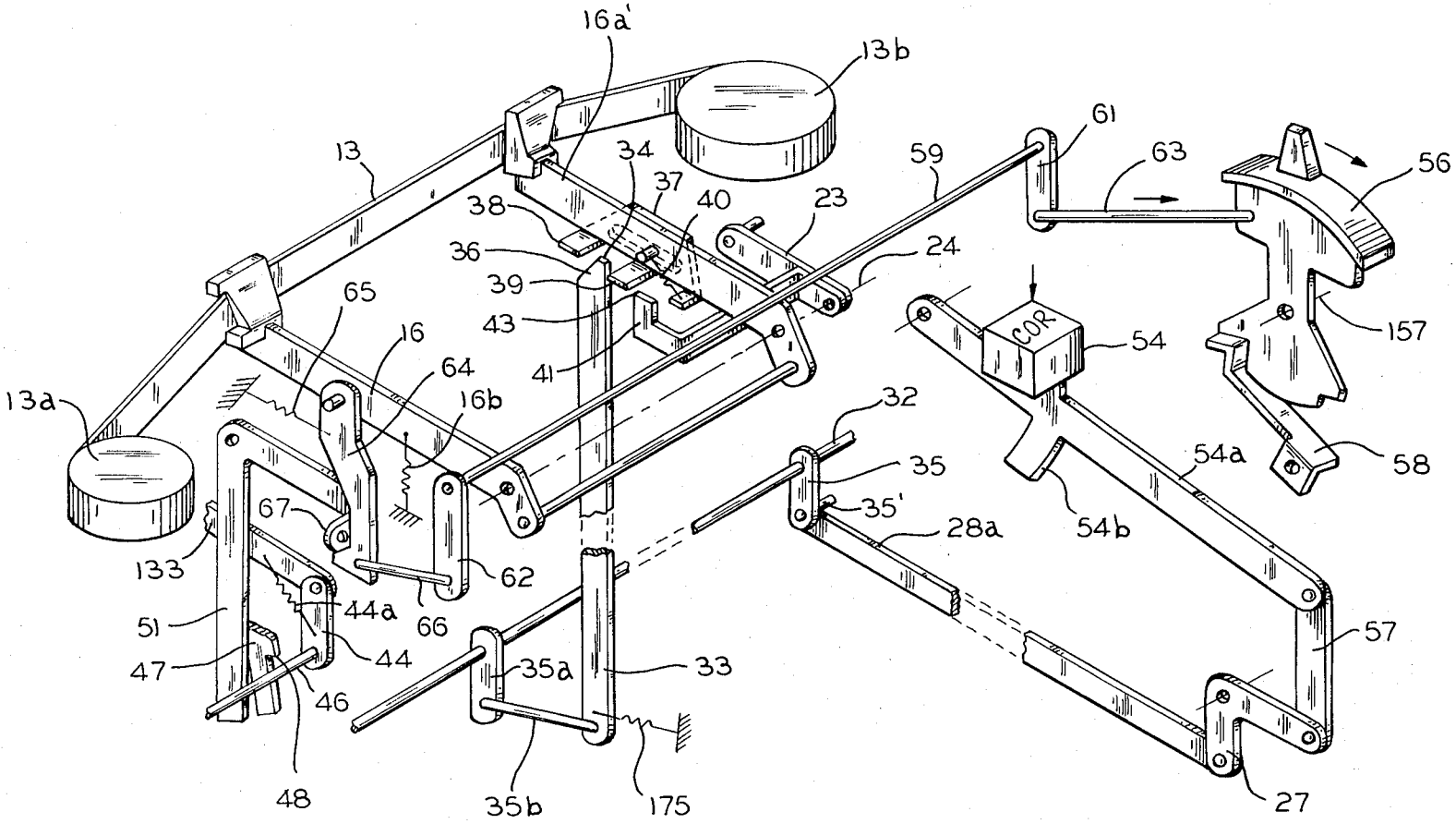
FIG. 4 is another fragmentary perspective view, similar to FIG. 2, but showing still another modified construction.

The embodiment illustrated in FIG. 4 is an improvement over the prior art typewriters illustrated in FIGS. 1, 2 and 3, and constitutes one aspect of the present invention. Corresponding parts shown in FIGS. 1, 2 and 3 and repeated in FIGS. 4 through 6 are identified by corresponding reference numerals.

As seen in FIG. 4, the improvement includes a ribbon field control selector lever 56 which is suitably pivotable about axis 157 a cooperating detent spring 58 for holding the lever 56 in a selected position, as will be hereinafter explained. A rocker shaft 59 is provided with a pair of rigid arms 61 and 62. Arm 61 is connected to selector lever 56 by a link 63. A latching pawl 64 is pivotally supported at its upper end on yoke 16 and at its lower end is connected to arm 62 by a link 66. The pawl 64 replaces the link 49 shown in FIG. 2. The pawl 64 is normally biased by a spring 65 into engagement with a lateral tab 67 integral with the bell crank 51. When the parts are disposed in the relationship illustrated in FIG. 4, the mechanism will function in letter correcting mode, that is, obliteration without spacing, as previously described. However, when the selector lever 56 is moved forwardly in the direction of the arrow, corresponding to word correcting mode, the machine is conditioned to space on every obliterating print function. In such mode rocker shaft 59 through link 63 and arm 61 is rotated to move through arm 62 and link 66 in the direction of the arrow to draw pawl 64 away from engagement with tab 67. Thus, when correction key 54 is actuated ribbon vibrator yoke 16 will be rocked upwardly to elevate correcting ribbon 13 to operative position, in the manner previously described.

In the letter correcting mode, as shown in FIG. 4, bell crank 51 would normally rock to engage pin 46 and clear it from engagement with shoulder 48 to prevent spacing. In the word correcting mode, pawl 64 will have been rotated to clear tab 67 so that elevation of yoke 16 will not cause rocking of bell crank 51. Pin 46 will remain in a position to engage shoulder 48 and allow operation of the spacing function. Accordingly, in such one cycle of operation, the actuation of correction key 54 has effected obliteration of an incorrect character and permitted the platen 11 (see FIG. 1) to move and come to rest aligned with the next character of the word. Successively repeated actuations of correcting key 54 can therefore effect obliteration of a single word or a complete line. The selector 56 may be left in either position, that is, word correct or letter correct and the typewriter will function in a normal manner for regular printing operations.

Figure 5:
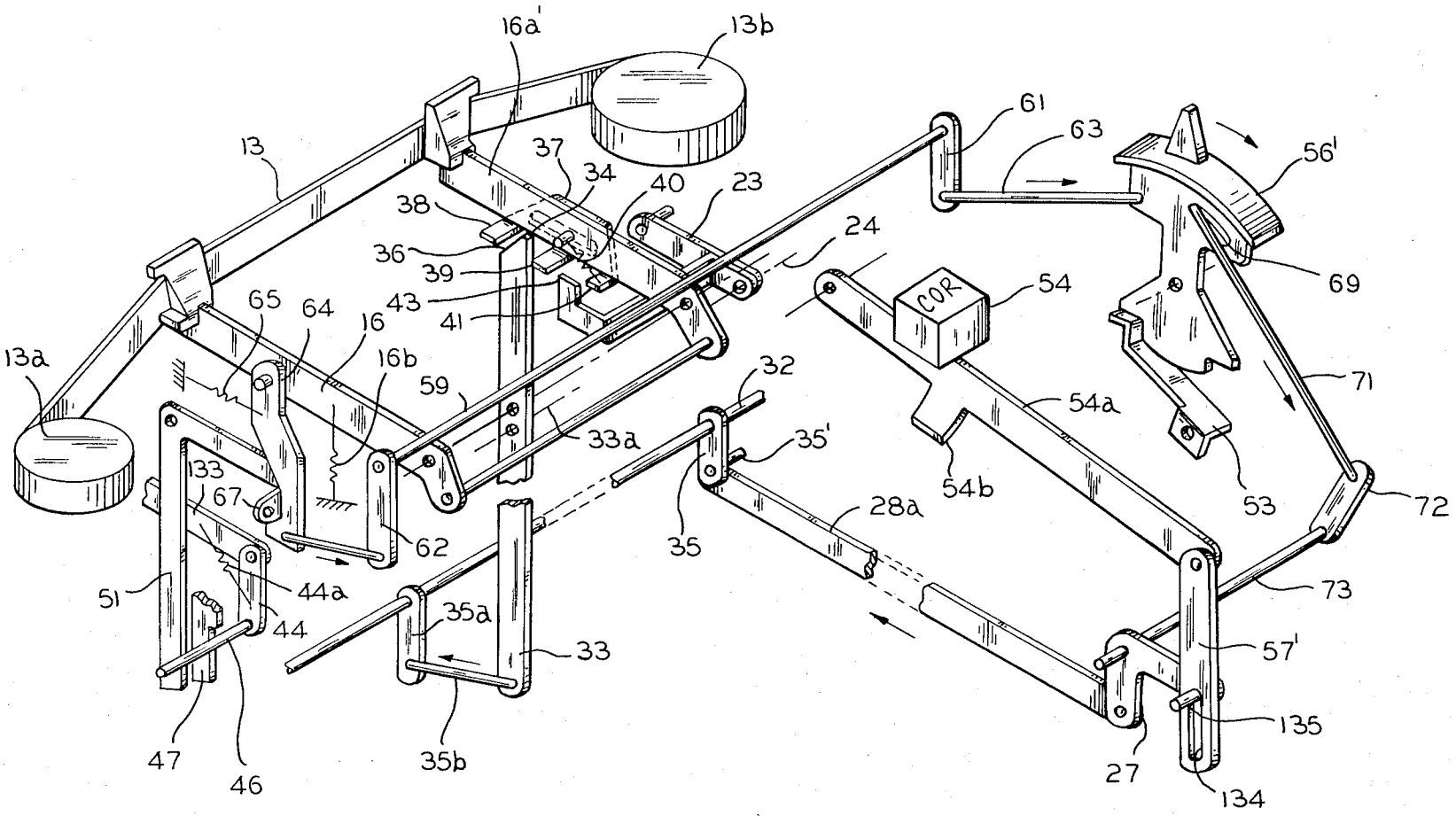
FIG. 5 is a fragmentary perspective view, similar to FIG. 4, but showing a modified construction of the same.
Figure 6:
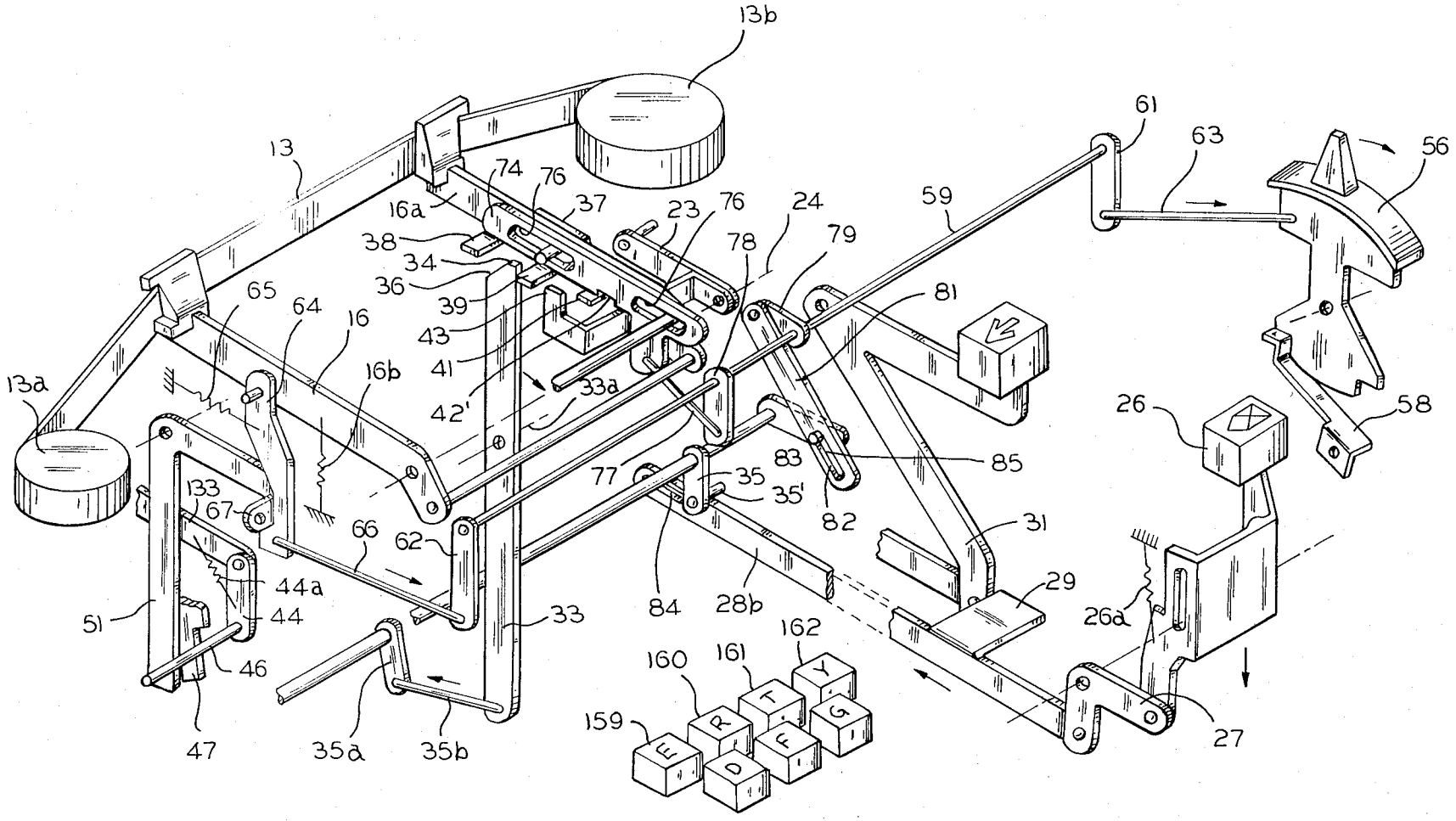
FIG. 6 is a fragmentary perspective view, similar to FIG. 3, but showing still another modified construction of the same.

FIG. 5 shows a modification of the arrangement shown in FIG. 4. As seen in FIG. 5 the selector lever 56 is provided with a lost-motion slot 69 in which is received one end of a drive link 71, with the opposite end of the drive link 71 being connected to an arm 72 fixed on rocker shaft 73 to which the bell crank 27 also is fixed. Lever 54*a* is pivotally connected to link 57' which also is provided with a lost-motion slot 134 in which is received a pin 135 carried on bell crank 27.

In operation, with the parts disposed in the relationship illustrated in FIG. 5, when correction key 54 is depressed bell crank 27 is rocked clockwise to shift lever 28*a* rearwardly in the direction of the arrow. Rocker shaft 73 will be correspondingly rocked to shift link 71 to the right, in the direction of the arrow. However, due to the lost-motion slot 69, the selector lever 56' will not be affected and will remain in the position shown in FIG. 5. Also, because of slot 134, forward movement of selector lever 56' will rotate the bell crank 27 without affecting link 57'. Thus, when the selector lever 56' is moved to its forward position, corresponding to word correcting position, rocker shaft 59 is rotated counterclockwise to effect disengagement of pawl 64 from tab 67 and thereby condition the machine for forward spacing. Concurrently, rocker shaft 73 through its associated linkage including lever 33 will move slide member 37 forwardly so that any following print operation will elevate the correcting ribbon 13 to effect obliteration of an error character. Actuation of correction key 54 now will cause obliteration by a blank type face such as the obliterating type face 156 shown in FIG. 3 and also spacing of the platen such as the platen 11 shown in FIG. 1. In the alternative, actuation of any print key will effect letter-on-letter obliteration, including spacing, so that an unwanted word may be obliterated through conventional typing of that same word on a letter-on-letter basis.

A further embodiment of the invention is illustrated in FIG. 6. This embodiment incorporates the features shown in FIGS. 2 and 4 and additionally includes other features presently to be described which convert the typewriter from a letter-on-letter system of obliteration, without spacing, to a letter-on-letter system of obliteration, with spacing. As seen in FIG. 6 a second slidable member 74 provided with two elongated slots 76 is mounted contiguous to the inner surface of arm 16*a* and is connected by a link 77 to arm 78 which is rigid with rocker shaft 59. Said slidable member 74 includes a detent 42' in its lower edge which is normally in registry with detent 42. A second arm 79 rigid with shaft 59 is connected to link 81 provided with a lost-motion slot 82. An arm 83 fixed on rocker shaft 32 has a pin 85 at one end engaged in slot 82. Link 28*b* is provided at its distal end with a lost-motion slot 84 in which is received a pin 35' fixed on the end of arm 35.

In operation, depression of control key 26 will rock bell crank 27 to shift link 28*b* rearwardly to rotate rocker shaft 32 clockwise, thereby rocking lever 33 so that its upper end 34 engages tab 39 and shifts slide member 37 forwardly to operative mode wherein tab 41 is latched in recess 42, in the same manner previously described. Pawl 64 will be engaged with bell crank 51 and the platen 11 (see, e.g., FIG. 1) will not space on the next print function. However, when slidable member 74 is shifted forwardly, detent 42' will be displaced so that tab 41 cannot enter into the detent 42 and be latched therein. Such shifting is effected by moving the selector lever 56 forwardly in the direction of the arrow to word correct mode. As seen in FIG. 6 forward movement of link 63 which is connected to selector lever 56 will rotate rocker shaft 59 counterclockwise shifting through link 77 slider member 74 forwardly to displace detent 42'. Also, the counterclockwise rotation of rocker shaft 59 through arm 62 and link 66 will draw the pawl 64 away from engagement with tab 67 on bell crank 51. Concurrently, rocker shaft 32 is caused to be rotated clockwise through arm 79, link 81 and arm 83 to rock lever 33 so that the upper end 34 engages tab 39 to shift slide member 37 forwardly. It is noted that due to lost-motion slot 84, link **28*b* was not shifted and, accordingly, the backspacing mechanism including lever 31 was not operated. The typewriter now is conditioned so that actuation of any print function key such as 159, 160, 161 and 162 will elevate the correcting ribbon 13 and will forward space for each print cycle. In operation, after the platen such as the platen 11 shown in FIG. 1 is adjusted to align the first letter of an unwanted word with the normal print point, conventional typing of that same word letter-on-letter will effect obliteration of the word. When the selector lever 56 is in the letter-on-letter correction mode as shown in FIG. 6, due to the lost-motion slot 82, rocker shaft 59 will not be affected by actuation of control key 26 and, every print function will operate in its normal mode. When the selector lever 56 is moved to its forward position the use of control key 26 is not required to effect correction. The actuation of any print function key such as 159** will effect correction together with spacing.

It should be apparent from the foregoing that the addition or use of a selector lever 56 or 56' and associated mechanism, as hereinabove described, to typewriters having a character-for-character correction system including automatic backspacing or non-backspacing and non-forward spacing after obliteration, provides an additional optional operational mode whereby character-for-character correction can be achieved with automatic forward spacing after each obliteration thereby providing simplified word obliteration with a minimum of typing strokes.

Figure 7:
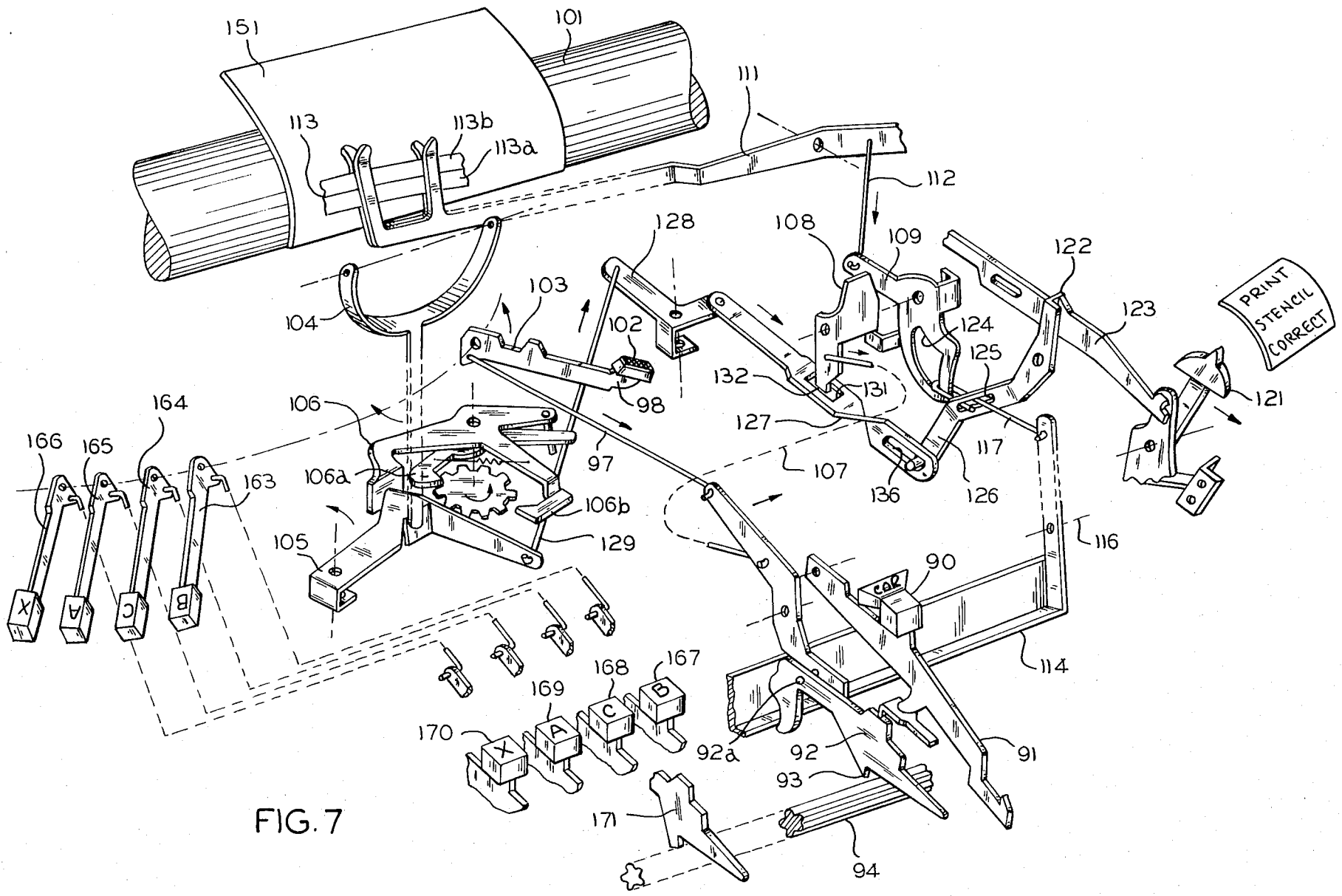
FIG. 7 is a fragmentary perspective view of the mechanism of a typebar typewriter, related to the error correction features.

FIG. 7 illustrates an embodiment of my invention as applied to typebar printing element machines exemplified in a commercial typewriter, Model No. 5395, manufactured by Brother Industries Ltd. of Japan and utilizing an obliterating type face and a single ribbon with two fields.

Referring to FIG. 7, the operation of the typewriter in a conventional manner will first be described. Depression of correction key 90 on keybar 91 will rock lever 92 about rivet **92*a* connecting lever 92 to bell crank 96 causing lever 92 to engage its depending tooth 93 with power roll 94 thereby driving lever 92 rearwardly and through bell crank 96 and link 97 accelerating typebar 98 to rock in the direction of the platen 101. The typebar 98 at its distal end carries an obliterating type face 102 and is provided with a recess 103 in its edge. The other conventional printing typebars in the machine such as 163, 164, 165 and 166 do not include a recess such as recess 103. Accordingly, during the final travel of such a typebar 163, the portion of the typebar 163 corresponding to the recessed area 103 will strike the escapement arch 104 displacing the same to rock escapement crank 105 thereby actuating pawls 106*a* and 106*b* through member 106 and resulting in a forward spacing of the platen 101. In the present construction because of the clearance provided by the recess 103, when the typebar 98 is actuated, the escapement arch 104 is not engaged by the typebar 98, hence, the member 106 is not actuated and no spacing will occur. Concurrent with the actuation of typebar 98, the rocking of bell crank 96, through ribbon vibrator link wire 107, will rock correction crank 108 which will engage and rock ribbon vibrator operating crank 109 causing ribbon vibrator 111 through link 112 to raise the obliterating ribbon portion 113*a* to a position to be impacted by the type face 102**.

When any printing key such as 167, 168, 169 and 170 is depressed and its respective lever such as 171 corresponding to lever 92 is rocked rearwardly by power roll 94, the trailing edge of the lever 171 engages bar 114 so that it is rocked about its pivotal axis 116 to draw wire link 117 forwardly thereby rocking the vibrator operating link 109 to locate the printing ribbon portion **113*b*** in operating position.

As seen in FIG. 7, the particular typewriter model, above identified, includes a conventional ribbon selector lever 121 capable of being manually moved to one of three positions, the rearward position being indicated by the legend "PRINT", intermediate position being indicated by the legend "STENCIL" and the forward position being indicated by the legend "CORRECT". Selector lever 121 is connected to selector crank 122 through link 123. As will be apparent, rocking of selector lever 121 will effect corresponding rocking of selector crank 122 which will effect adjustment of the height of wire link 117 passing through slot 125 in selector crank 122 in relation to the cam profile 124 of ribbon drive crank 109. Movement of the bar 114 and wire link 117 will result in a variety of angular movements of ribbon drive crank 109 to dispose ribbon 113 in different positions. In the lowermost position of wire link 117 the ribbon vibrator 111 will be elevated a short distance just sufficient to present the printing field **113*b* of the ribbon 113 to the impacting type face 102. In the intermediate position of wire link 117 the clearance provided by cam 124 will not result in angular displacement of drive crank 109 and, accordingly, the ribbon 113 will not be interposed between the type face 102 and platen 101. In the highermost position of wire link 117 the angular displacement of ribbon drive crank 109 will be greatest and, accordingly, travel of the ribbon vibrator 111 will be such as to interpose the obliterating field 113*a* of the ribbon 113 between the type face 102 and platen 101**. It will be understood that the mechanism above described is conventional.

In accordance with my invention I have provided selector crank 122 with an integral depending arm 126 and have added a link 127, a bell crank 128 and a wire link 129. As seen in FIG. 7, the arm 126 is connected to link 127 through an elongated slot 136. Link 127 is provided intermediately thereof with an elongated slot 131 which is disposed in close proximity to the pawl 132 of driving crank 108. Link 127 is connected to crank 128 which through wire link 129 is connected to escapement crank 105. When selector lever 121 is disposed in its forward position corresponding to CORRECT position, link 127 will be elevated so that pawl 132 will enter slot 131 and will be in position to engage the forward edge of said slot 131. Any angular displacement of correction crank 108 by wire link 107 will effect forward movement of link 127 to rock bell crank 128 clockwise whereby wire link 129 will draw escapement crank 105 in a counterclockwise direction to actuate member 106 and effect actuation of pawls 106*a* and 106*b* there by to effect movement of the platen 101. When selector lever 121 is in its rearward position corresponding to PRINT position, as shown in FIG. 7, link 127 is in its lowest position so that slot 131 is spaced from pawl 132 and, accordingly, normal typing may be performed with the platen 101 advancing after the actuation of each character print key 167–170. When correction key 90 is depressed to actuate typebar 98 and type face 102, a single character will be obliterated without forward advancement of the platen 101.

When selector lever 121 is in forward or CORRECT position all struck characters may be obliterated by normal typing of character-on-character with spacing. Alternatively, actuation of correction key 90 will effect obliteration with the obliterating type face 102 spacing for every actuation of the key 90. It will be apparent that if the correction key 90 is provided with automatic repeat capability, the use of such a key 90 can now provide simple and rapid one key word correction.

It will be understood that the term character-on-character obliteration means the use of a character type font or face which is identical to the printed error character in effecting a correction, while the term character-for-character obliteration means the use of a single obliterating type font or face for obliterating any printed error character.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In a typewriter having ribbon means for providing a printing and a print obliterating field, means for supporting paper thereon, printing means, means for positioning a printing point, and instrumentalities for providing individual character obliteration with or without initial backspacing, together with means for preventing forward advancement of the printing point relative to paper on said supporting means following an obliterating operation to permit insertion of a single correct character without further manipulation of the printing point positioning means, the improvement comprising optional means for selectively effecting forward spacing of the printing point after each obliteration whereby to effect consecutive obliterations of a series of characters with a minimum number of operations.

2. In a typewriter for use with ribbon means providing a printing and a print obliterating field, said typewriter including printing means having a plurality of character keys, means for supporting paper thereon, means for normally advancing a printing point incident to a printing operation when any of said character keys is depressed, means for preventing normal advance of the printing point, means for effectively positioning either one of said ribbon fields between said printing means and paper on said supporting means, means to select a ribbon field and means for moving the printing point either in an advance or backspace direction and including instrumentalities for automatically backspacing the printing point incident to an obliterating operation, conditioning the ribbon means for positioning the print obliterating field in the correction mode for a single obliterating operation and preventing normal advance of the printing point whereby in the next printing operation the printing field is rendered effective and advance of the printing point will occur, the improvement comprising optional means operatively connected to the means for normally advancing the printing point and operable when selectively actuated to render the means for preventing normal advance of the printing point ineffective so as to permit the printing point to advance immediately following an obliterating operation.

3. The invention as defined in claim 2 in which the instrumentalities include a non-printing control key to initiate sequential functions.

4. In a typewriter for use with ribbon means providing a printing and a print obliterating field, said typewriter including printing means having a plurality of character keys and a correction key including an obliterating type face, means for supporting paper thereon, means for normally advancing a printing point incident to a printing operation when any of said character keys is depressed, means for preventing normal advance of the printing point, means for effectively positioning either one of said ribbon fields between said printing means and paper on said supporting means, means to select a ribbon field and means for moving the printing point either in an advance or backspace direction, and including instrumentalities for conditioning the ribbon means for positioning the print obliterating field in the correction mode for effecting a single obliterating operation by the obliterating type face and preventing normal advance of the printing point whereby in the next printing operation the printing field is rendered effective and advance of the printing point will occur, the improvement comprising optional means operatively connected to said means for normally advancing said printing point and operable when selectively actuated to render the means for preventing normal advance of the printing point ineffective so as to permit the printing point to advance immediately following an obliterating operation thereby permitting obliteration of a series of consecutive characters by repeated actuation of said correction key.

5. In a typewriter for use with ribbon means providing a printing and print obliterating field, said typewriter including printing means having a plurality of character keys and a correction key including an obliterating type face, means for supporting paper thereon, means for advancing a printing point incident to a printing operation when any of said character keys is depressed, means for preventing advance of the printing point, means for effectively positioning either one of said ribbon fields between said printing means and paper on said supporting means, manual means to select a ribbon field and means for moving the printing point either in an advance or backspace direction, and including instrumentalities for conditioning the ribbon means for positioning the print obliterating field in the correction mode for effecting a single obliterating operation by the obliterating type face and preventing advance of the printing point whereby in the next printing operation the printing field is rendered effective and advance of the printing point will occur, the improvement comprising means operatively connecting said ribbon field selector means to said ribbon field positioning means, and linkage means connecting said ribbon field selector means to said means for advancing the printing point whereby actuation of said ribbon field positioning means will condition the means for advancing the printing point to effect the forward advancement of the printing point.

6. In a typewriter having ribbon means for providing a printing and a print obliterating field, means for supporting paper thereon, printing means and instrumentalities for providing individual character obliteration with or without initial backspacing, together with means for preventing forward advancement of the paper supporting means following an obliterating operation to permit insertion of a single correct character without further manipulation of the paper supporting means, the improvement comprising optional means for selectively effecting forward spacing of the paper supporting means after each obliteration whereby to effect consecutive obliterations of a series of characters with a minimum number of operations.

7. In a typewriter for use with ribbon means providing a printing and a print obliterating field, said typewriter including printing means having a plurality of character keys, means for supporting paper thereon, means for normally advancing said paper supporting means incident to a printing operation when any of said character keys is depressed, means for preventing normal advance of the paper supporting means, means for effectively positioning either one of said ribbon fields between said printing means and paper on said supporting means, means to select a ribbon field and means for moving said paper supporting means either in an advance or backspace direction and including instrumentalities for automatically backspacing said paper supporting means incident to an obliterating operation, conditioning the ribbon means for positioning the print obliterating field in the correction mode for a single obliterating operation and preventing normal advance of the paper supporting means whereby in the next printing operation the printing field is rendered effective and advance of the paper supporting means will occur, the improvement comprising optional means operatively connected to the means for normally advancing the paper supporting means and operable when selectively actuated to render the means for preventing normal advance of the paper supporting means ineffective so as to permit the paper supporting means to advance immediately following an obliterating operation.

8. The invention as defined in claim 7 in which the instrumentalities include a non-printing control key to initiate sequential functions.

9. In a typewriter for use with ribbon means providing a printing and a print obliterating field, said typewriter including printing means having a plurality of character keys and a correction key including an obliterating type face, means for supporting paper thereon, means for normally advancing said paper supporting means incident to a printing operation when any of said character keys is depressed, means for preventing normal advance of the paper supporting means, means for effectively positioning either one of said ribbon fields between said printing means and paper on said supporting means, means to select a ribbon field and means for moving said paper supporting means either in an advance or backspace direction, and including instrumentalities for conditioning the ribbon means for positioning the print obliterating field in the correction mode for effecting a single obliterating operation by the obliterating type face and preventing normal advance of the paper supporting means whereby in the next printing operation the printing field is rendered effective and advance of the paper supporting means will occur, the improvement comprising optional means operatively connected to said means for normally advancing the paper supporting means and operable when selectively actuated to render the means for preventing normal advance of the paper supporting means ineffective so as to permit the paper supporting means to advance immediately following an obliterating operation thereby permitting obliteration of a series of consecutive characters by repeated actuation of said correction key.

10. In a typewriter for use with ribbon means providing a printing and a print obliterating field, said typewriter including printing means having a plurality of character keys and a correction key including an obliterating type face, means for supporting paper thereon, means for advancing said paper supporting means incident to a printing operation when any of said character keys is depressed, means for effectively positioning either one of said ribbon fields between said printing means and paper on said supporting means, manual means to select a ribbon field and means for moving said paper supporting means either in an advance or backspace direction, and including instrumentalities for conditioning the ribbon means for positioning the print obliterating field in the correction mode for effecting a single obliterating operation by the obliterating type face and preventing advance of the paper supporting means whereby in the next printing operation the printing field is rendered effective and advance of the paper supporting means will occur, the improvement comprising means operatively connecting said ribbon field selector means to said ribbon field positioning means, and linkage means connecting said ribbon field selector means to said means for advancing said paper supporting means whereby actuation of said ribbon field positioning means will condition the means for advancing said paper supporting means to effect the forward advancement of the paper supporting means.

* * * * *

UNITED STATES PATENT AND TRADEMARK OFFICE

CERTIFICATE OF CORRECTION

PATENT NO. : 4,492,485

DATED : January 8, 1985

INVENTOR(S) : John C. Gall

It is certified that error appears in the above-identified patent and that said Letters Patent is hereby corrected as shown below:

In the Cover Page, in the References Cited, "3,154,318" should read --3,154,183--, and insert --3,204,746 9/1965 Wolowitz ...400/697.1

Column 3, line 20, "on" should read --to--. Column 4, lines 15 and 16, "153, 154 and 155, e.g. 152" should read --e.g. 152, 153, 154 and 155--; and line 59, "16a" should read --16a'--. Column 5, line 34, "157 a" should read --157 and a --. Column 6, line 10, "56" should read --56'--. Column 8, line 30, before "intermediate" insert --the--. Column 9, line 7, "there by" should read --thereby--.

Signed and Sealed this

Tenth Day of September 1985

[SEAL]

*Attest:*

DONALD J. QUIGG

*Attesting Officer* *Acting Commissioner of Patents and Trademarks - Designate*